US007537813B2

(12) United States Patent
Mottelet et al.

(10) Patent No.: US 7,537,813 B2
(45) Date of Patent: May 26, 2009

(54) SOUND-INSULATING GLAZING WITH THERMOVISCOUS LOSSES

(75) Inventors: Beatrice Mottelet, Compiegne (FR); Marc Rehfeld, Ezanville (FR)

(73) Assignee: Saint-Gobain Glass France, Courbevoie (FR)

( * ) Notice: Subject to any disclaimer, the term of this patent is extended or adjusted under 35 U.S.C. 154(b) by 387 days.

(21) Appl. No.: 10/520,514

(22) PCT Filed: Jul. 9, 2003

(86) PCT No.: PCT/FR03/02138

§ 371 (c)(1),
(2), (4) Date: Sep. 22, 2005

(87) PCT Pub. No.: WO2004/007886

PCT Pub. Date: Jan. 22, 2004

(65) Prior Publication Data

US 2006/0162280 A1 Jul. 27, 2006

(30) Foreign Application Priority Data

Jul. 15, 2002 (FR) ..... 02 08937

(51) Int. Cl.
*E06B 3/00* (2006.01)
*E04C 2/54* (2006.01)
*E04B 9/00* (2006.01)

(52) U.S. Cl. ..... 428/34; 181/289; 52/786.1; 52/786.13

(58) Field of Classification Search ..... 428/34; 181/284, 289, 290; 52/786.1, 786.13
See application file for complete search history.

(56) References Cited

U.S. PATENT DOCUMENTS 3,921,359 A * 11/1975 Brichard et al. ..... 52/786.13

FOREIGN PATENT DOCUMENTS

| | | |
|---|---|---|
| DE | 23 50 602 | 4/1975 |
| DE | 27 48 223 | 5/1979 |

* cited by examiner

*Primary Examiner*—Donald Loney
(74) *Attorney, Agent, or Firm*—Oblon, Spivak, McClelland, Maier & Neustadt, P.C.

(57) ABSTRACT

An acoustic insulating glazing unit including at least two substrate sheets, joined together around their periphery using a device that forms a sealed joint and a spacer frame, which device, with the two substrate sheets, defines a flat cavity filled with a gas. At least one microcavity is formed over at least part of the periphery of the cavity, constituting a zone of thermoviscous losses from the cavity along at least one of internal walls of the two substrate sheets by which the cavity is bounded. Dimensions of the at least one microcavity are chosen to promote propagation of some of the acoustic waves from the cavity into the microcavity, generating thermoviscous losses and thus reducing acoustic energy of the cavity. A mechanism is provided to contain the acoustic waves escaping from the microcavity.

9 Claims, 3 Drawing Sheets

SOUND-INSULATING GLAZING WITH THERMOVISCOUS LOSSES

BACKGROUND OF THE INVENTION

The present invention relates to a glazing unit with improved acoustic insulation performance.

DISCUSSION OF THE BACKGROUND

It is common practice in buildings to use insulating glazing units to improve the thermal insulation of rooms. The glazing units in question comprise two glass sheets, generally of different thickness, joined together by means of a spacer frame, which keeps them a certain distance apart, trapping a layer of gas, such as air, between them.

Various means have been proposed hitherto for improving the acoustic performance of insulating glazing units, like that reported in PCT international application WO 00/75473. These means may in particular consist of a waveguide that is placed around the periphery of the glazing unit and communicates with the air layer via several orifices, the shape, cross section and position of which are determined so as to mismatch the acoustic and mechanical waves that are generated in the air layer and over the glass sheets, respectively, when the glazing unit is subjected to an incident acoustic field.

Also known, from German patent application DE-A-2 803 740, is an acoustic insulating double glazing unit that includes, on the inside, for the purpose of improving the acoustic performance, an additional section attached to the peripheral spacer frame via an elastic link.

BRIEF SUMMARY OF THE INVENTION

The Applicant has sought to further improve the acoustic performance of such glazing units and has developed a novel type of configuration of the section attached to a spacer frame or associated with the latter, this section forming, against the transparent substrate walls, microcavities in which the acoustic waves become "exhausted" by friction against their facing walls, causing thermoviscous losses, that is to say converting the waves into thermal energy and, consequently, reducing the acoustic energy. The glazing units according to the present invention may thus be termed glazing units with "a thermoviscous loss effect" and, as the results indicate below show, make it possible to achieve substantial improvements in the acoustic performance.

The first subject of the present invention is therefore an acoustic insulating glazing unit comprising at least two substrate sheets, joined together around their periphery using a device that forms a sealed joint and a spacer frame, which device, with the two substrate sheets, defines a flat cavity filled with a gas, characterized in that formed over at least part of the periphery of said cavity is at least one microcavity, constituting a zone of thermoviscous losses from said cavity along at least one of the internal walls of the two substrate sheets by which said cavity is bounded, the dimensions of a microcavity being chosen to promote the propagation of some of the acoustic waves from the cavity into the microcavity, generating thermoviscous losses and thus reducing the acoustic energy of said cavity, means being provided in order to contain the acoustic waves escaping from said microcavity.

In accordance with the present invention, some of the acoustic waves in a cavity of the glazing unit are mainly absorbed in the medium-frequency and high-frequency ranges.

Advantageously, a microcavity is in the form of a thin layer, the width of which is between 0.2 mm and 1 mm, limits inclusive, and the useful height of which is at least equal to 6 mm, preferably at least equal to 11 mm.

If the thickness of a microcavity is greater than one millimeter, the expected effect of reducing the acoustic energy of the cavity will not be obtained. It is also important that the useful height of the microcavity be sufficient, so that there is a large friction area for the acoustic wave, resulting in thermoviscous losses that are thought to be the cause of the reduction in acoustic energy. However, it should be emphasized that the increase in the useful height of the microcavity will be limited by the need to maintain an acceptable daylight in the case of transparent glazing.

According to one advantageous embodiment of the present invention, at least one microcavity is formed on at least one face and at least on one of the sides of the glazing unit; in particular, provision will be made for at least one microcavity to be formed on each of the faces of the glazing unit, especially over the entire periphery of the latter.

In one particular embodiment, a microcavity is formed between the internal wall of a substrate sheet and a facing wall of a section placed at the internal periphery of the cavity and defining an inner chamber that communicates with the microcavity via at least one opening made in said wall of the section, said chamber making it possible to contain the acoustic waves escaping from the microcavity. In particular, an opening is formed by a continuous or discontinuous longitudinal slot over the entire length of a section. A discontinuous slot will be preferred in order to maintain the stiffness of the section.

The slot or slots will be placed in the lower part of the section opposite the cavity, namely as close as possible to the bottom of the microcavities so as to maximize the useful height of the microcavities and consequently the area of the friction surfaces. It will be understood that the term "useful height" of a microcavity is understood to mean the distance between the upper plane of the slot and the plane where the microcavity runs into the cavity.

A slot may, for example, have a height of the order of 1 mm.

A function of the slots is to ensure natural circulation of the gas (air) in order to force the latter to penetrate into the microcavity. This circulation is improved if a configuration is provided with microcavities on each face of the glazing unit, and this represents a preferred embodiment.

Thus, the section is advantageously formed by an element of at least U-shaped cross section, the bottom of which is in contact with the gas-filled cavity and the flanges define the inner chamber, and the flanges each define a microcavity with the facing wall of the substrate and cooperate via their base with the device that forms the sealed joint/spacer frame.

According to an alternative embodiment, the device forming the sealed joint/spacer frame consists of a frame having a bottom in contact with a peripheral gasket that adheres to the internal edges of the two facing substrate sheets, and flanges spaced opposite the substrate sheets with interposition of a continuous or discontinuous bonding/sealing bead, the U-shaped section for forming the microcavities being attached to said insert frame or being formed as one piece with it, in which case the flanges of the insert frame are extended in order to form those of said U-shaped section.

According to another alternative embodiment, the device forming the sealed joint/spacer frame consists of a peripheral foil that adheres to the edges of the two substrate sheets, the U-shaped section for forming the microcavities being attached to said foil.

The substrate sheets that form the double glazing or multiple glazing units according to the present invention may consist of monolithic glass, laminated glass or what is called "acoustic" laminated glass, that is to say one that incorporates, as an insert sheet lying between the glass sheets, at least one film of particular plastics having acoustic properties. In this case, the acoustic performance due to these films with acoustic properties will add to those due to the configuration with the "thermoviscous loss effect" of the present invention.

BRIEF DESCRIPTION OF THE SEVERAL VIEWS OF THE DRAWTNGS

To illustrate the subject matter of the present invention better, particular embodiments thereof will now be described with reference to the appended drawings in which.

DETAILED DESCRIPTION OF THE INVENTION

Figure 1:
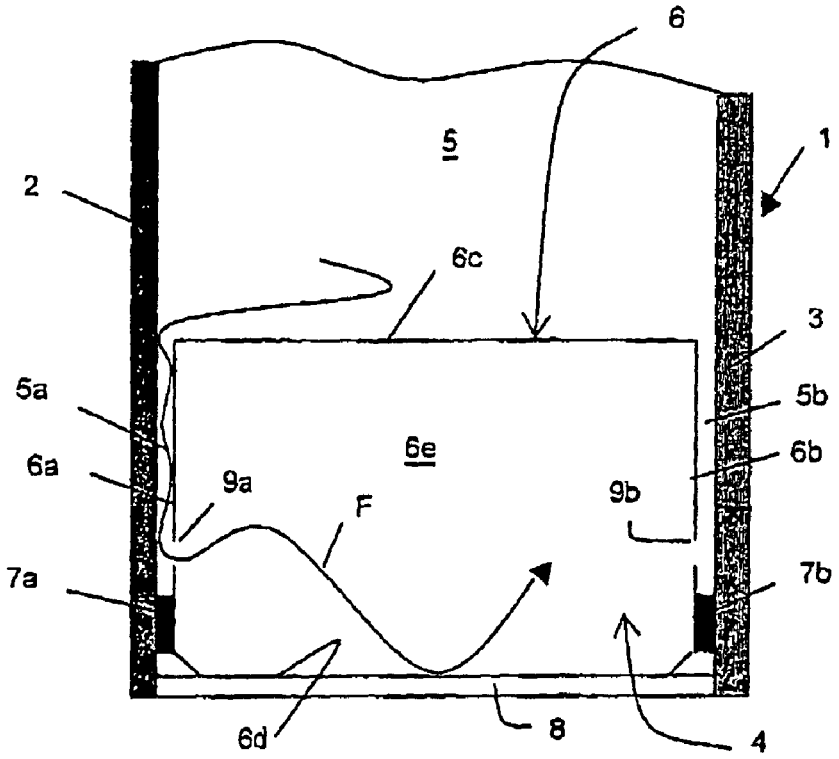
FIG. 1 is a schematic partial cross-sectional view in a border region of a double glazing unit according to a first embodiment of the invention.

Referring to FIG. 1, it may be seen that an acoustic insulating double glazing unit is denoted in its entirety by 1, this unit comprising two glass sheets 2, 3, of different thickness, that are kept separated by means of a peripheral device 4 forming a sealed joint/spacer frame, the sheets 2, 3 and the device 4 defining a flat sealed cavity 5, containing a gas such as air.

The device 4 is composed of a spacer frame 6 consisting of a section that comprises two side walls 6*a*, 6*b*, each in contact with the facing glass sheet with interposition of a longitudinal bonding/sealing bead 7*a*, 7*b*, respectively. The bonding/sealing beads 7*a*, 7*b* are continuous.

The frame 6 may be made of metal (for example aluminum) or of a composite, and the bonding/sealing beads may be made of butyl rubber, for example.

The two side walls 6*a*, 6*b* are closed on the internal side by a front transverse wall 6*c* and on the external side by a bottom transverse wall 6*d* that adheres to a peripheral gasket 8 made of polysulfide that is bonded to the internal borders of the two facing glass sheets 2 and 3. The gasket fulfills, apart from the function of bonding and mechanically supporting the glazing unit, the function of sealing against gas, dust and liquid water. It should be noted that sealing against water vapor is provided by the butyl beads 7*a*, 7*b* and by the presence of the facing aluminum 6*d*.

The two walls 6*a*, 6*b* of the section 6 each have, parallel to the respective bonding/sealing beads 7*a*, 7*b*, a respective longitudinal slot 9*a*, 9*b* that may be continuous or discontinuous.

Thus, a microcavity 5*a* is formed between the glass sheet 2 and the wall 6*a* and a microcavity 5*b* is formed between the glass sheet 3 and the wall 6*b*, the microcavities 5*a* and 5*b* having the shape of thin layers running into the cavity 5, the gas contained in the latter circulating via these microcavities 5*a*, 5*b* and via the slots 9*a*, 9*b* in the inner chamber 6*e* of the spacer frame 6, which also constitutes the section with a "thermoviscous loss effect" that constitutes one feature of the present invention.

The schematic representation shown in FIG. 1 is not drawn to scale; indicated below are the main characteristic dimensions:

| | |
|---|---|
| thickness of the glass sheet 2: | 4 mm |
| thickness of the glass sheet 3: | 6 mm |
| thickness of the cavity 5: | 20 mm |
| thickness of a bead 7a, 7b/width of a microcavity 5a, 5b: | 0.2 mm |
| distance between the walls 6c and 6d: | 20 mm |
| distance between the wall 6a and the upper border of a slot 9a, 9b/useful height of a microcavity 5a, 5b: | 15 mm |

Shown symbolically in FIG. 1 by the arrow F is the path of a sound wave in the microcavity 5*a*. The configuration of the present invention is such that the wave is encouraged to move into this microcavity, while undergoing friction against the walls that define this microcavity, its acoustic energy decreasing because of these thermoviscous losses.

The acoustic attenuation coefficients as a function of frequency for double glazing units according to FIG. 1 were obtained by measurements and by calculations, by varying the useful height of the microcavities 5*a*, 5*b*: 4.5 mm; 6 mm; 11 mm and 16.5 mm, and by taking as control a conventional spacer frame, with no lateral slots, the wall 6*c* of which lies in the plane of the upper border of the beads 7*a*, 7*b* (control:air).

From these curves may be calculated the overall gain $R_{A,tr}$ and gain $R_W$ coefficients relative to the control, according to the EN ISO 717 Part 1 standard:

| Useful height of the microcavities (mm) | Gain $R_{A,tr}$/Cont. (dB) | Gain $R_w$/Cont. (dB) |
|---|---|---|
| 6.5 | 0 | 1 |
| 11 | 1 | 2 |
| 16.5 | 2 | 3 |

The embodiment shown in FIG. 1 requires the height of a typical spacer frame to be modified, such as that used for the control double glazing unit.

Figure 2:
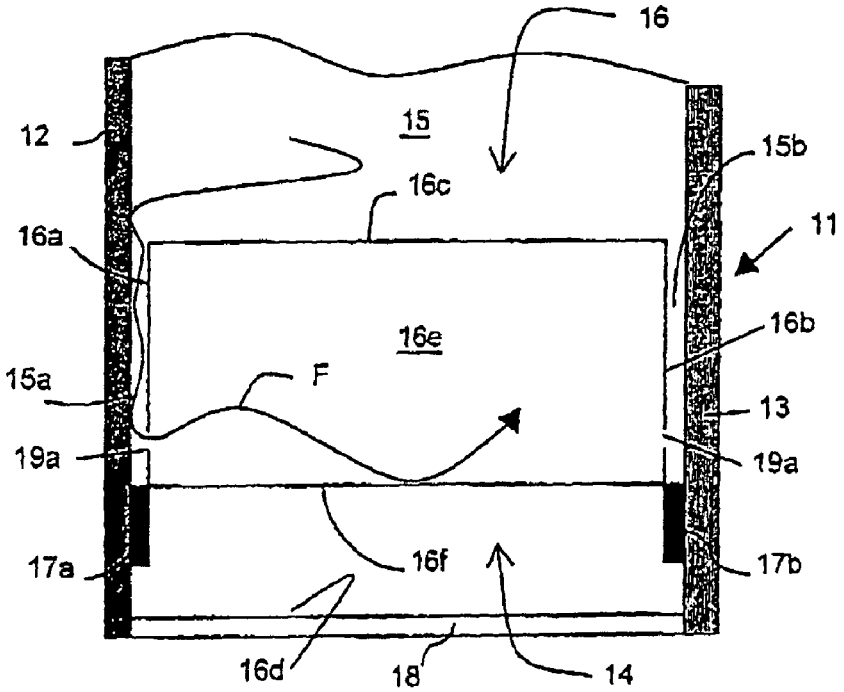
FIGS. 2 and 3 are views similar to FIG. 1 of a double glazing unit according to a second and a third embodiment of the invention, respectively.

To illustrate the embodiment shown in FIG. 2, reference numerals have been used that are ten higher than those used to denote the analogous elements in FIG. 1. This embodiment differs from that of FIG. 1 by the fact that what is used is a typical spacer frame closed by a transverse wall 16*f* lying in the plane of the upper border of the beads 17*a*, 17*b* and that a section 16, comprising a bottom 16*c* and two flanges 16*a*, 16*b* having respective slots 19*a*, 19*b*, has been attached to this frame. The section 16 may be attached to the standard spacer frame by any means, such as bonding, welding or coextrusion.

Figure 3:
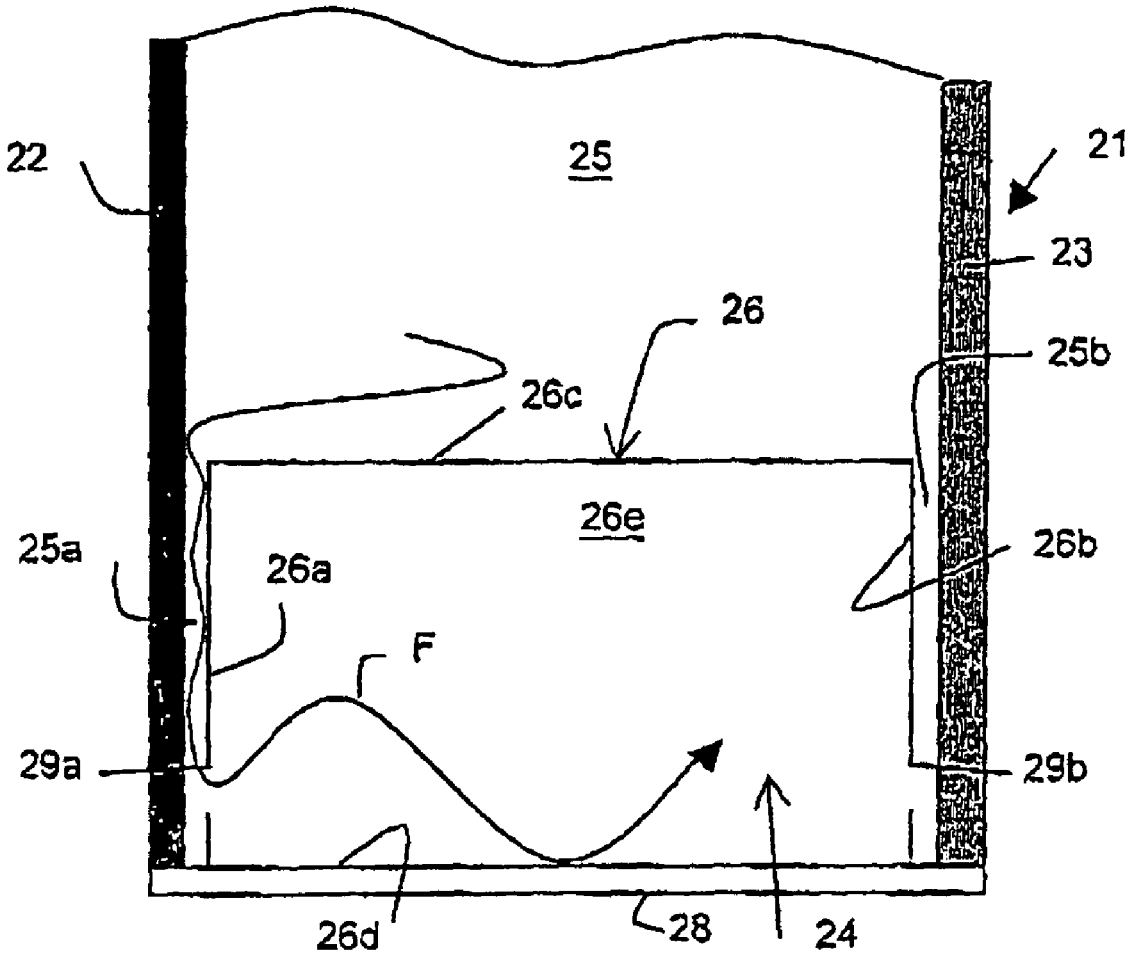
Figure 4:
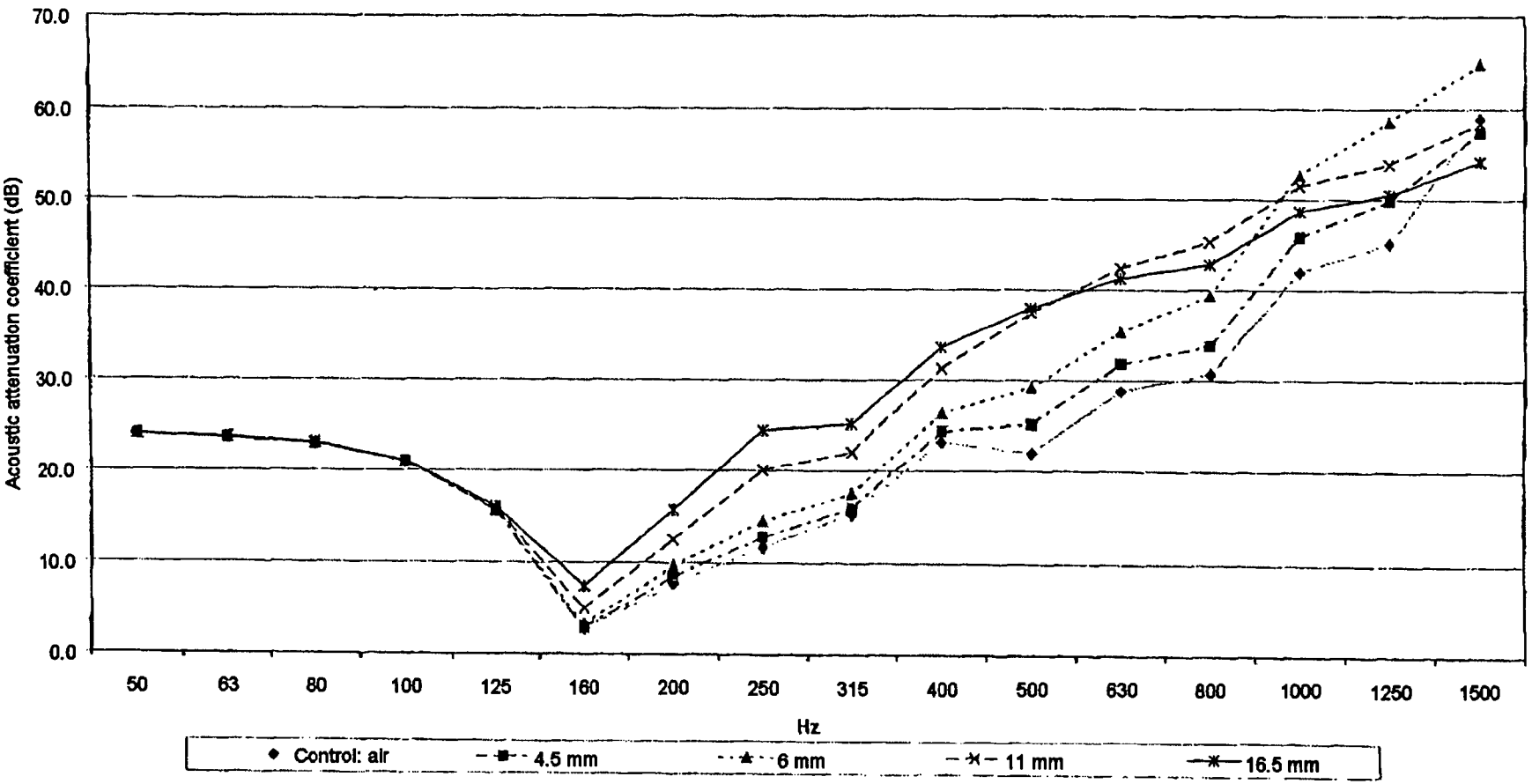
FIG. 4 shows the curves of the acoustic attenuation coefficient as a function of frequency for different microcavity heights and compared with a control glazing unit with no microcavity.

To illustrate the embodiment shown in FIG. 3, reference numerals have been used that are twenty higher than those used to denote the analogous elements in FIG. 1. This embodiment differs from that of FIG. 1 by the fact that the device 24 is limited to a peripheral foil 28 that adheres to the edges of the two glass sheets 22 and 23 and by the fact that the U-shaped section 26, which comprises the bottom 26*c* and the flanges 26*a* and 26*b* with the respective slots 29*a* and 29*b*, is attached directly to the foil 28. The foil 28 is, for example, made of aluminum and thus provides a complete seal.

It should be clearly understood that the particular embodiments described above were given by way of indication and imply no limitation and that modifications and alternative embodiments may be provided without in any way departing from the scope of the present invention.

The invention has been described in the case of an insulating glazing unit comprising at least two transparent glass substrate sheets. It also applies to insulating glazing units in which the substrates are not necessarily transparent and/or made of glass, such as metal, polycarbonate or methacrylate substrates.

The invention claimed is:

1. An acoustic insulating glazing unit comprising:

at least two substrate sheets, joined together around their periphery using a sealed joint/spacer frame, the sealed joint/spacer frame defining with the two substrate sheets a flat cavity that is filled with a gas;

an interior frame arranged inside the flat cavity in a periphery of the flat cavity, wherein side walls of the interior frame and internal walls of the at least two substrate sheets define at least one microcavity having dimensions to form a zone of thermoviscous losses for acoustic waves entering from the flat cavity, wherein the interior frame includes an inner chamber and opening slots that are arranged in the side walls of the interior frame, the inner chamber configured to receive the acoustic waves escaping from the at least one microcavity through the opening slots, and wherein a height of the at least one microcavity from an upper wall of the interior frame to the opening slots is at least 6 mm, and the at least one microcavity has a width between 0.2 mm and 1 mm.

2. The glazing unit as claimed in claim 1, wherein the height of the at least one microcavity is at least equal to 11 mm.

3. The glazing unit as claimed in claim 1, wherein the interior frame is arranged around an entire periphery of the glazing unit, and forms two microcavities between the internal walls of a first and a second substrate sheets of the at least two substrate sheets.

4. The glazing unit as claimed in claim 1, wherein the opening slots are formed by at least one of a continuous and discontinuous longitudinal slot provided in a lower part that is closer to the outer periphery of the glazing unit of the side walls of the interior frame.

5. The glazing unit as claimed in claim 4, wherein a height of the slot is around 1 mm.

6. The glazing unit as claimed in claim 1, wherein the interior frame has a U-shaped cross section arranged so that a bottom of the U-shape cross section faces the gas-filled cavity, and the side walls define the inner chamber and also define the at least one microcavity with the internal wall of the substrate sheets.

7. The glazing unit as claimed in claim 6, wherein the sealed joint/spacer frame includes:

an insert frame having a bottom portion that is in contact with a peripheral gasket that adheres to internal walls of the substrate sheets, and flanges placed opposite the substrate sheets with interposition of a continuous or discontinuous bonding/sealing bead, wherein the U-shaped cross section for forming the at least one microcavity being attached to the insert frame or being formed as one piece with the insert frame.

8. The glazing unit as claimed in claim 6, wherein the sealed joint/spacer frame includes:

a peripheral foil that adheres to edges of the two substrate sheets, wherein the U-shaped section for forming the at least one microcavity is attached to the foil.

9. The glazing unit as claimed in claim 1, wherein one substrate sheet is formed by at least one of a monolithic glass, a laminated glass, and an acoustic laminated glass.

* * * * *